United States Patent [19]

Jacobsen et al.

[11] 4,352,649

[45] Oct. 5, 1982

[54] APPARATUS FOR PRODUCING A NON-WOVEN WEB FROM PARTICLES AND/OR FIBERS

[75] Inventors: Edmond M. Jacobsen, Skanderborg; Otto V. Nielsen, Aarhus N.; Torsten B. Persson, Maarslet, all of Denmark

[73] Assignee: Scan-Web I/S, Risskov, Denmark

[21] Appl. No.: 132,131

[22] Filed: Mar. 20, 1980

[51] Int. Cl.[3] ..... B29J 1/00

[52] U.S. Cl. ..... 425/83.1; 425/141; 425/226

[58] Field of Search ..... 425/83.1, 82.1, 141, 425/226

[56] References Cited

U.S. PATENT DOCUMENTS

| | | | |
|---|---|---|---|
| 3,158,668 | 11/1964 | Johnson | 425/82.1 |
| 3,476,058 | 11/1969 | Watkin | 425/141 |
| 3,482,287 | 12/1969 | Flewwelling | 425/82.1 |
| 3,680,175 | 8/1972 | Kamp et al. | 425/83.1 |
| 4,157,724 | 6/1979 | Persson | 425/83.1 |
| 4,258,455 | 3/1981 | Werner | 425/83.1 |

*Primary Examiner*—James R. Hall
*Attorney, Agent, or Firm*—Craig and Antonelli

[57] ABSTRACT

A system for production of non-woven sheet material by the dry forming method, comprising a moving carrier web to receive a uniformly distributed layer of loose fibres and a fibre distributor unit located above and across the moving web. The distributor unit includes a closed conduit system for conducting a flow of air fluidized fibre material, this closed flow across the web being maintained by blowing action. The conduits located overhead the web are provided with outlet openings constituted by narrow slots or screen wall portion, and compressed air nozzles are arranged so as to cause fibres circulating in said flow crosswise to be moved crosswise in the flow outwardly through the outlet openings, whereby a high distributor capacity is obtained by simple means by forcing fibre material out of the outlet openings in a positive manner as distinguished from outlet by general suction from outside the outlet openings.

33 Claims, 12 Drawing Figures

APPARATUS FOR PRODUCING A NON-WOVEN WEB FROM PARTICLES AND/OR FIBERS

BACKGROUND AND SUMMARY OF THE INVENTION

The present invention relates to an apparatus for dry forming of fibers and/or particles into a non-woven web. A dry forming apparatus is known from U.S. Pat. No. 4,157,724 in which a distributor unit utilizes an upwardly open canister having lower side wall portions of a classification screen material to gradually deposit particle and/or fiber material onto the top surface of a moving, foraminous forming sheet in conjunction with a suction means located underneath the forming sheet. Inside of the distributor container are mounted rotary agitating members. The rotating agitator members act to create a recirculating flow that travels in a first direction along one side of the container and in an opposite direction along the opposite side of the container. Additionally, the agitating elements also impart to the material flow, a movement component directed outwardly toward the side wall portions formed of screen material. Thus, the agitating members serve to keep the material within the distributor container in a flow that is fluidized in air by a whipping action, and at the same time exerts a centrifugal action which results in a continuous throwing of fibers against the screen wall and therethrough. This action of the agitating members increases the output capacity of the distributor beyond that attainable simply by a suction action (as is also known in the art) and because the material moving in the flow along the screen wall portions is substantially evenly distributed inside the container along the screen wall portions, it is ensured that there are no stationary local fiber concentrations to disturb the evenness of the fiber output across the foraminous forming sheet.

While the above-noted, prior art system, operates with a satisfactory output and distribution evenness, it is not without certain disadvantages. These disadvantages relate mainly to the power requirements of the agitating members, which are in the form of impellers having whipping members mounted so as to radially extend from a rotary shaft, necessary for producing the desired dual effects of a recirculating flow within the distributor container and an outward displacement of material from the flow through the screen wall portions. Additionally, since both of these flow producing results are achieved by a common means, the output distribution and the recirculation flow production become necessarily interrelated, thereby reducing the flexibility of the system.

Accordingly, it is the object of the present invention to produce an apparatus of the above-noted, dry forming, type, wherein the good operational qualities may be retained in an advantageously simple manner via a design that is operable in a more flexible manner.

According to preferred embodiments of the present invention, by providing separate means for causing the fiber and/or particle material to be kept in an air fluidized recirculating flow and for removing material from this recirculating flow and directing it outwardly through a distributor screen wall portion onto a moving foraminous forming sheet. Thus, in accordance with the present invention, it is possible to adjust the recirculating flow and outwardly directed flow independently relative to each other, so that the output distribution from the distributor container can be regulated so as to enable the cross-sectional profile of the deposited material layer to be controlled. In accordance with various embodiments disclosed herein, the recirculating flow of material may be produced by an air blower, while the removal of portions of said flow and directing thereof through a screen wall portion to the forming sheet may be achieved by either air nozzles or a rotating needle cylinder.

These and further objects, features and advantages of the present invention will become more obvious from the following description when taken in connection with the accompanying drawings which show, for purposes of illustration only, several embodiments in accordance with the present invention.

DETAILED DESCRIPTION OF THE PREFERRED EMBODIMENTS

Figure 1:
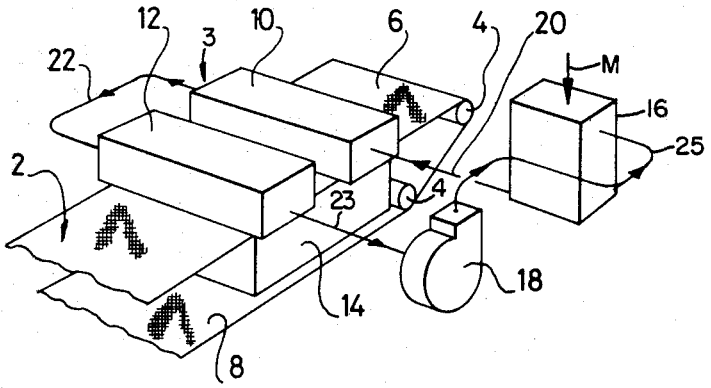
FIG. 1 is a perspective view of an apparatus for forming a non-woven web from particles and/or fibers in accordance with the present invention, in schematic form.

In FIG. 1, the first embodiment of the invention shows that the apparatus has three basic components. Namely, a moving foraminous forming sheet 2, a distributor unit 3 that it positioned above an upper run 6 of the forming sheet 2, and a suction means 14 positioned beneath the upper run 6 of the forming sheet 2. The endless foraminous forming sheet 2 is guided about roller 4 so as to create an endless loop having an upper horizontal run 6 and a lower horizontal return run 8. The distributor unit 3 comprises a pair of distributor boxes 10, 12 which receive loose fibers produced in a fiber material disintegrator (hammer mill) 16 by way of an air flow produced by a blower 18 and pipes 20, 22, pipe 20 connecting the hammer mill with the first distributor box 10, and pipe 22 connecting distributor box 10 with distributor box 12. The flow circuit is completed by return pipes 23 and 25, pipe 23 connecting distributor box 12 with blower 18, and pipe 25 connecting blower 18 with hammer mill 16. The suction box 14 operates in a well-known manner to produce a downward air flow through the screen 2 at a position located beneath the distributor boxes 10 and 13. Accordingly, material M delivered to the disintegrator 16 is broken into fibers or particles which are recirculated in a closed path, a portion thereof being distributed by the distributor boxes 10, 12 onto the upper surface of the moving foraminous sheet 2 in conjunction with the suction force applied by the suction box 14.

Figure 2:
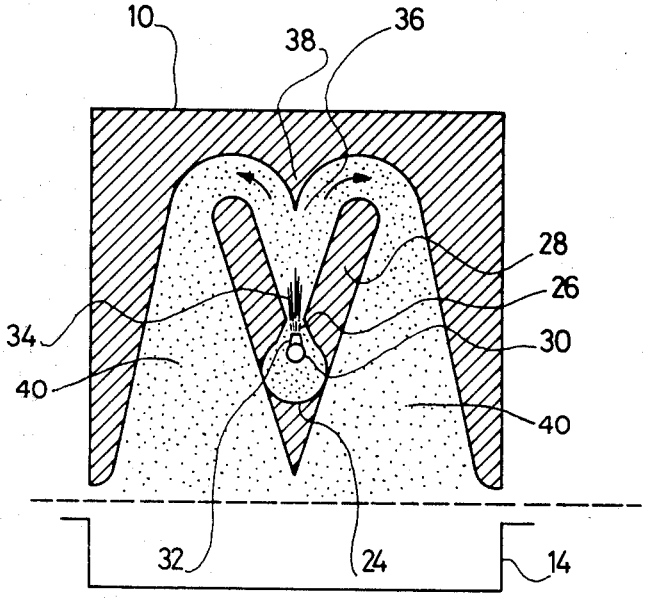
FIG. 2 is a sectional view of a distributor unit of the FIG. 1 embodiment.

In FIG. 2, distributor box 10 is shown in cross-section. The distributor box 10 comprises a horizontally through-going air duct 24 which interconnects the air pipes 20 and 22 so as to conduct the fiber ladden air from the disintegrator unit 16 through the distributor box. The duct 24 is provided with an upper slot 26. Slot 26 is located adjacent the interior of a bottom portion of a generally V-shaped cross member 28 that is located centrally within the box structure 10. The interior wall of the outer box structure is shaped so as to flair outwardly in a downward direction from a point located above the upper end of the V-shaped cross member 28. Inside of the air duct 24, a pipe 30 is mounted. Located along the top of the air duct 24 is a row of radially-directed nozzles 32 or, alternatively, an elongated, upwardly-directed nozzle slit. Pipe 30, in a manner not shown, is connected with a source of compressed air, whereby an upwardly-directed air jet 34 is produced along the length of the duct. The air jet 34 will have the character of an air "knife" operating to blow a portion of the fibers from inside of the duct 24 upwardly into the wider space 36. From space 36, the particles are guided by a central ridge portion 38 in the direction, indicated by arrows, outwardly to both sides of the ridge portion from which the fibers travel downwardly through the widening spaces 40 at both sides of the cross member 28. In these spaces 28, the air flow will be relatively slow and laminar, and the fibers will have the opportunity to spread themselves and fall or be sucked onto the upper surface of the foraminous forming sheet 2 in a continuous, uniform manner.

Preferably, the nozzle means 32 are arranged in such a manner, as shown, that the said air knife does not primarily serve to blow out fibers from the duct 24 in a direct manner, but merely to produce an ejector effect along the slot 26 such that the fibers are drawn out from the duct together with some of its transportation air.

It will be noted and appreciated that, contrary to normal practice, the bottom of the distributor box structure 10 should not be provided with a stationary screen, as the disintegration of the fibers is maintained during the travel of the fibers inside the box, where even the said air knife may show an additional disintegrating effect.

It could be a natural tendency that the amount of fibers ejected from the slot will be higher adjacent the inlet end than adjacent the outlet end thereof. Such a difference, of course, may be counteracted by appropriate, selective dimensioning of the slot 26 and/or the air nozzle 32, but it will be counteracted also by the fact that, in the following distributor box 12, the duct inlet and outlet are inverted to produce an opposite differentiation, if any, so, in the final product, an even layer thickness will be obtainable. The production line, of course, may comprise more than the two boxes 10 and 12 shown in FIG. 1.

Figure 3:
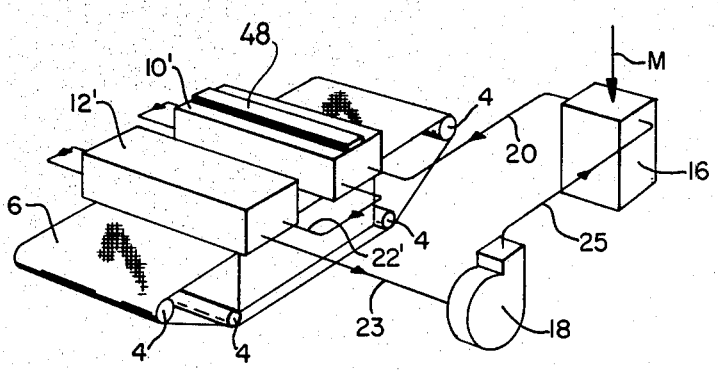
FIGS. 3 and 4 are views which are similar to FIGS. 1 and 2, respectively, but are of a modified apparatus.
Figure 4:
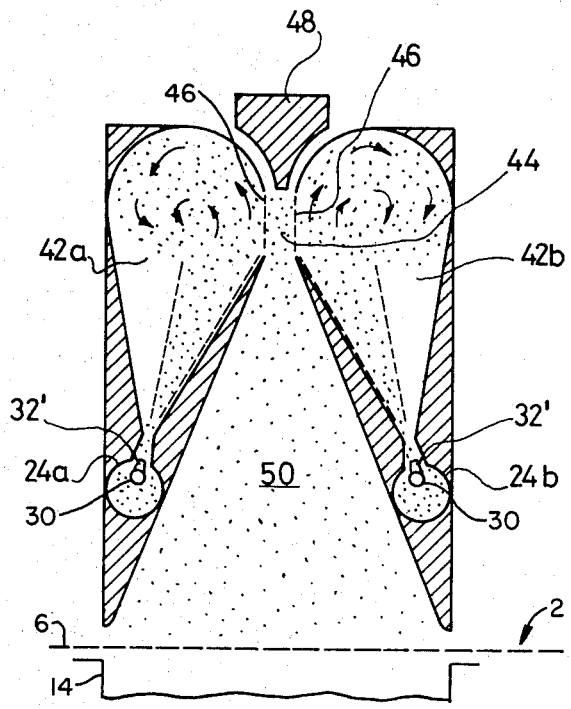

In FIGS. 3 and 4, a modification of the FIG. 1, 2 embodiment is shown. In accordance with this modified embodiment, each of the distributor boxes 10, 12 is replaced by a distributor box 10', 12'. Distributor boxes 10', 12' differ from distributor boxes 10, 12 in that they are provided with two parallel, symmetrically arranged ducts **24*e* and 24*b* which are interconnected in series, instead of one central duct 24. Each of the ducts 24*a*, 24*b* is provided with a respective "air knife" 32' for delivering fibers to upper chambers 43*a*, 42*b* which widen upwardly and are shaped so as to enable the fibers to circulate therein in the manner shown by arrows. The chambers 42 both open towards a central, vertical duct portion 44, either directly or preferably through screen wall portions 46. The top end of the duct portion 44 communicates with the atmosphere through or past a valve member 48, while the lower end of the duct portion 44 communicates with a central, downwardly flaring space 50 inside of the box. The space 50 opens towards and just above the foraminous sheet 2**.

Suction applied by the suction box 14 underneath the sheet 2 causes a flow of air to be taken into the top valve 48 in a manner producing a downwardly-directed air flow in duct portion 44. The downwardly-directed air flow functions as an air ejector which sucks air and fibers from the chambers **42*a*, 42*b* through the duct-confining screens 46. From duct portion 44, the fibers travel into the downwardly widening space 50. In space 50, the air velocity gradually decreases and the fibers are spread under the same conditions as in the chambers 40 of the FIG. 1, 2** embodiment.

In both of the preceding embodiments, the relatively large fiber spaces 40 and 50, respectively, are located directly above the foraminous sheet 2 and contribute to a uniform distribution of the fibers on the foraminous sheet 2. This occurs because, if the distribution of fibers is relatively thicker in certain areas, those areas will have a reduced suction effect passing therethrough, while the suction effect at other, more thinly deposited areas will experience a correspondingly increased suction effect. This factor coupled with the relatively long falling distance of the fibers through the spaces 40, 50, enables the fibers to be readily guided to those areas of amplified suction effect, thereby resulting in the evenness of the fiber layer deposited upon the forming sheet 2 being improved, at least to some degree. On the other hand, it is preferred that the air velocity inside the distributor boxes is such that the fibers, despite the relatively long falling distance, are sucked down onto the foraminous forming sheet 2 in a very rapid and direct movement. The reason for this rapid movement is that once the fibers have been disintegrated by the action of the air knives 32, 32', care should be taken that they do not get the chance to rejoin, which might result in lump formations.

According to a further aspect of the invention, to facilitate the above-noted rapid transference of the particles, the ejector area may be very close to the foraminous forming sheet 2, so as to exhaust the flow of fibers in a concentrated area across the sheet 2, without the use of any large distributor box structure. Correspondingly, the suction produced underneath the sheet 2 should not be provided by means of a large suction box, but rather by a narrow suction nozzle or slit located underneath the fiber exhaust area.

Figure 5:
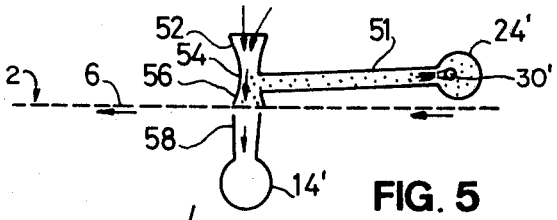
FIG. 5 is a sectional schematic view illustrating a further modification.

FIG. 5 illustrates schematically another manner in which the fibers may be supplied (from the hammer mill 16). In this arrangement, a cross-duct 24', in a manner similar to ducts 24, **24*a* and 24*b*, has particles exhausted therefrom by means of an air knife arrangement, as described above. In this case, however, the particles are exhausted laterally (instead of upwardly) into a flat channel 51, by means of the air knife arrangement 30'. An opposite end of channel 51 communicates with a further ejector arrangement, comprising an upper air intake 52, a narrow middle portion 54 (at one side of which the channel 51 is connected), and a lower, downwardly widening portion 56 which terminates just above the foraminous forming sheet upper run 6. At the same location, immediately underneath the upper run 6, is placed a transverse, narrow suction nozzle 58 which is connected with a suction pipe 14'. The suction nozzle 58 is operable to effect a high suction rate through the run 6 and through the ejector system located above same. As a result, the fibers are ejected from the channel 51 and are practically instantaneously deposited upon run 6. Theoretically, the fibers could be delivered to the forming sheet in a direct manner by the air knife 30', but a channel 51 of a certain length is believed advantageous for increasing the evenness of the fiber layer as deposited upon the screen. Again, for increasing the overall uniformity of the deposited layer, the air knife may be designed with dimensions which gradually change across the foraminous forming sheet, and several systems may be mounted in a row lengthwise of the sheet. The free air intake through the upper ejector portion 52** may be replaced by a downwardly-directed air knife arrangement of the type already described. Likewise, other modifications within wide limits can also be achieved without departing from the scope of the present invention.

Figure 8:
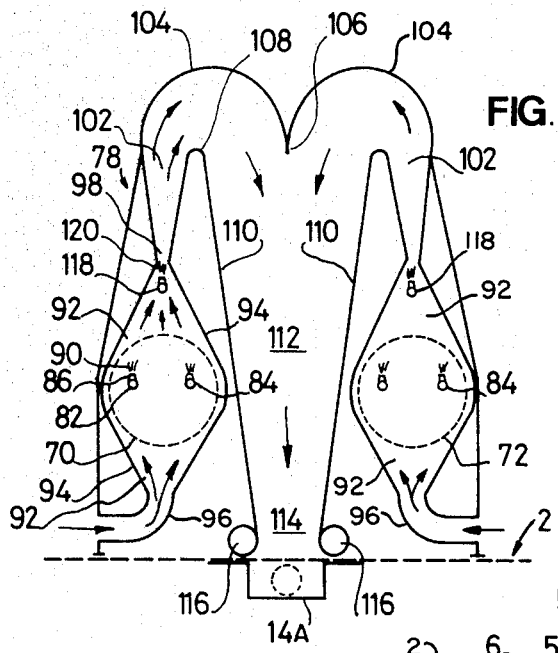
FIGS. 7 and 8 are sectional top and end views, respectively, of the FIG. 6 apparatus.
Figure 6:
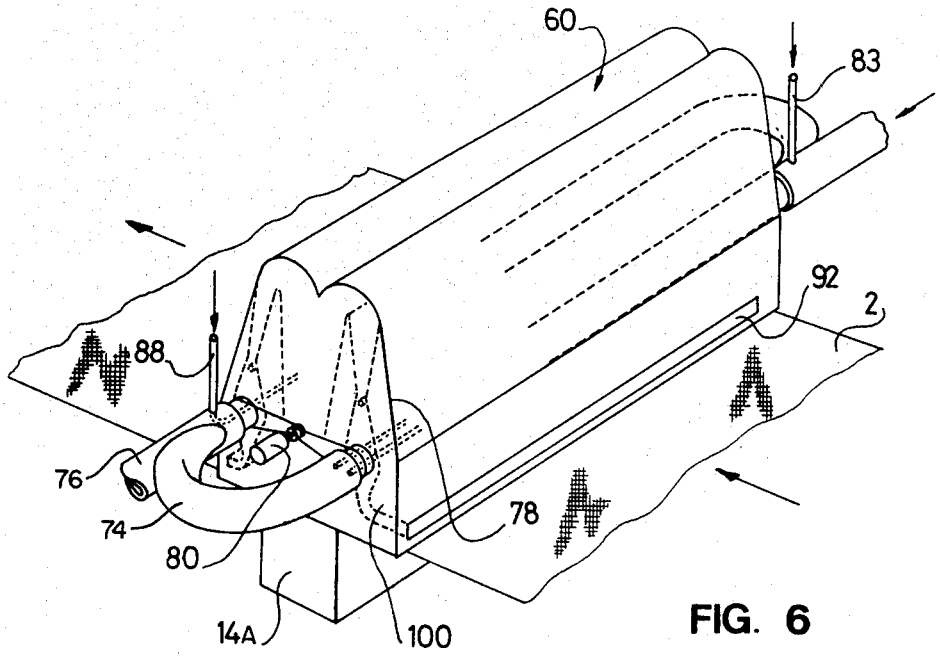
FIG. 6 is a perspective view of still a further modified apparatus.
Figure 7:
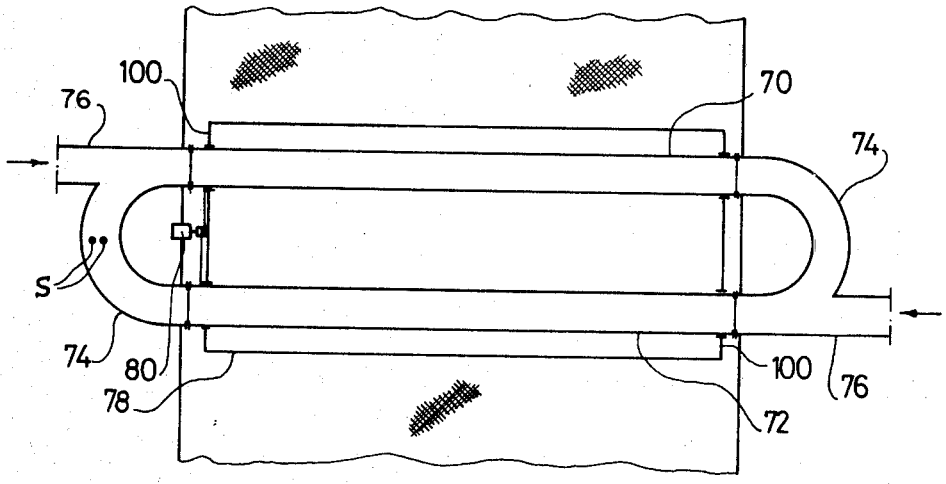

In accordance with the embodiment illustrated in FIGS. 6–8, a further modified distributor unit (indicated generally as 60) is utilized instead of the distributor boxes of the previous embodiments, in conjunction with a similar forming sheet 2 and a suction box **14*a*** located therebeneath.

The distributor unit 60 comprises, as a main structure, a pair of parallel tube elements 70, 72 which are interconnected at their respective ends by way of half-circular connected pipes 74. Connected tangentially to each pipe 74 is a supply pipe 76. Each supply pipe is axially-aligned with a respective one of the tubes 70, 72, as shown. Thus, a circulation pipe system is provided which enables a flow of fiber laden air to be introduced through both of the supply pipes 76, in a manner not shown, by being connected in parallel to the outlet of a hammer mill or other disintegrator producing the flow of fiber laden air. In fact, one of the supply pipes could be sufficient for feeding the pipe system 70, 72, 74.

The tube wall of each of the tubes 70, 72 is constituted by a classification screen. Furthermore, each tube is mounted in the unit housing 78 so as to be rotatable about its own asix. The ends of the tubes 70, 72 are connected in a sealed, but freely rotatable manner to the ends of the respective fixed pipes 74, 76. A motor 80 serves to rotate the two tubes 70, 72.

A pair of axially-extending air pipes 82, 84 (FIG. 8) is arranged inside of each of the screen tubes 70, 72. Each of the air pipes 82, 84 is provided with upwardly-directed outlet nozzles 86. Nozzles 86 are supplied with compressed air by exterior air pipes 88 that extend through the fixed pipe portion 74, 76. This supply of compressed air can serve to support the stationary air pipes 82. The nozzles 86 are arranged in the respective first and second quadrants of the tubes 70, 72 (as seen in cross section, FIG. 8) and which blow jets of air 90, so as to hit the inside of the tubes at an oblique angle.

Each of the screen tubes 70, 72 extends through a chamber 92 formed between upwardly and downwardly converging, opposed side walls 94. The lower end of the chamber 92 is connected to a slot-like channel 96, while, at the upper end of the chamber, a slot-formed opening 98 is provided extending all the way across the unit between the end plates 100. Above the slot 98, an extension of the chamber walls 94 project in a diverging manner so as to form a widening chamber portion 102. The outer wall of each chamber portion 102 continues in an arched wall portion 104, of almost half-circular cross-section. The arched wall portions join together at a central, downwardly-directed ridge 106. The two structures, so formed, are generally symmetrically mirror-image arranged about the vertical plane through the ridge 106.

The inner side wall of each of the upper chambers 102 continues through an arched portion 108 into a downwardly-extending wall portion 110. The two wall portions so formed converge downwardly towards each other and form a funnel-shaped chamber 122, which has an opening 114 at its lower end, just above the foraminous forming sheet 2. Adjacent the lower edge of each of the opposed wall portions 110, may be mounted a roller 116 which functions as a sealing means between the surroundings and the air flow conductor constituted by the chamber 112 and the suction box **14*a***.

Just underneath the slot 98, between the chambers 92 and 100, is arranged a stationary air pipe 118 having upwardly-directed nozzle means for providing a jet of air 120. The air jet 120 is directed up through the slot 98 in an almost constant manner along the full length of the slot 98. The pipe 118 (FIG. 8) is connected to a source of compressed air in a manner not shown.

In operation, when fiber ladden air is caused to be circulated in the supply pipe system 70, 72, 74, 76, the screen tubes 70 and 72 are rotated, air jets 90 and 120 are provided by the nozzle pipes 82, 84 and 118, and the foraminous forming sheet 2 is moved. Some of the loose fibers flowing through the rotating screen tubes will be subjected to the action of the air jets 90 and thus be blown out through the screen wall of the respective tubes into the chamber 92. The air jet 120 and the slot 98 form an ejector system which then operates to draw air from the chamber 92 so that the fibers which have passed through the screen wall will be maintained "suspended" in the air and caused to move in the direction of the arrows up and then downwardly into and through the central chamber 112, for deposit onto the forming sheet 2.

Relatively heavy particles circulating in the supply pipe system 70, 72, 74 may be separated by a takeout provided in an outer wall portion of one of the tubes 74. The lower slot opening 96 of the chamber 92 is utilized as an air intake opening for supplying air to the ejector arrangement constituted by the nozzle pipe 118 and the slot 98. Intake slot 96 may be interconnected with the suction box 14 to thereby create a closed air system in which the air may be conditioned in an optimal manner. This will be highly economical when the air temperature is required to be higher than the ambient or outdoor temperature. With the air circulating in the pipe system 70, 72, 74, 76, it is ensured that the fibers are kept suspended or fluidized in the air. Thus, even if fiber clumps or other undesired coarse particles exist in the air flow, it will be insignificant as long as they are actually kept circulating. While such coarse particles and clumps may tend to deposit themselves on the inside of the screen wall of the tubes 70, 72, where they would produce the undesirable effect of preventing loose fibers from penetrating the tube walls, since the tubes 70 and 72 are kept rotating, the insides thereof are swept by the air jets 90 so that any coarse particles or clumps deposited on the inside of the screen tube walls will be blown off and returned into the flow circulating within the system 70, 72, 74, 76. Accordingly, the fiber material being blown upwardly through the nozzle slot 98 will consist essentially of individual fibers only, and provisions may be made to remove any heavier particles traveling therewith since they will be slung outwardly and will pass along the arched top sides 104.

The various air nozzles 82, 84 and 118 may be continuous slot nozzles or individual nozzles placed reasonably close together along the pipes. In the latter case, the fiber delivery through the slot 98 may not be absolutely even lengthwise thereof, but, since the fibers will travel through the chambers 102 and 112 before they become deposited upon the forming sheet 2, they will tend, nevertheless, to reach the forming sheet in a manner that is evenly distributed throughout the length of the opening 114 of the central chamber 112.

For cleaning the inside of the screen tubes 70, 72, it is essential that the inner surfaces thereof be moved relative to the air jets 90. However, an alternative embodiment may comprise a stationary tube 70 or 72 and an air tube 82 or 84 arranged so as to rotate, continuously or in a reciprocating manner. In such a case, it would be sufficient to use a screen tube 70 or 72 which has only its upper half formed of a classification screen material, or the lower half could be made of a non-perforated plate material. A corresponding tube construction could also be usable in the instance where stationary air nozzles are utilized, if the tubes are merely reciprocated through a limited angle instead of being rotated. Since the air-fiber mixture circulating within the pipe system 70, 72, 74 will tend to have its fiber material thrown outwardly during passage through connector pipes 74, the thickness of the layer of fiber ladden air passing through these bends will correspond to the actual concentration of fibers in the transportation air. Because the concentration of fibers will express itself in the thickness of the fiber ladden air layer at the outer side of the connector pipes 74, it will be possible to detect the concentration by detecting the thickness of said layer. Since it is preferred to maintain this concentration as constant as possible for ensuring a constant fiber delivery from the tubes 70, 72 to the depositing area on the forming sheet 2, it is proposed, as shown in FIG. 7, to place suitable sensors S inside the pipe end 74 for detecting the thickness of the fiber ladden air portion flowing therethrough. Sensors S may function by way of capacitive measurement, and according to the measuring result (preferably only a max/min detection), an automatic adjustment of the fiber supply can be made so as to obtain a substantially constant supply to the output of the distributor unit 60.

It is noted that the measuring and adjustment by way of sensors is not restricted to use in conjunction with the distributor just described. This technique is applicable generally to distributor systems where the air-fiber flow is caused to be moved through an arched path, along which the fibers tend to concentrate along the interior of the outermost side of the path due to the action of centrifugal forces.

As mentioned, it will be possible to interconnect the intake slot 96 and the suction box 14 in order to provide for a closed air system. With such an arrangement, it will be possible to control the static air pressure at desired places with the use of suitably placed and controlled blowing and suction fans. An important possibility is thus that the static pressure in the area in which the air flow penetrates the foraminous sheet may be adjusted to correspond to the ambient air pressure, whereby there will be no pressure gradient into or out from the area in which the fibers are deposited. That is, the fiber layer is disturbed as little as possible. This advantage will apply to any closed distribution system irrespective of the manner in which the fiber distribution or distribution of other particles is accomplished.

Figure 9:
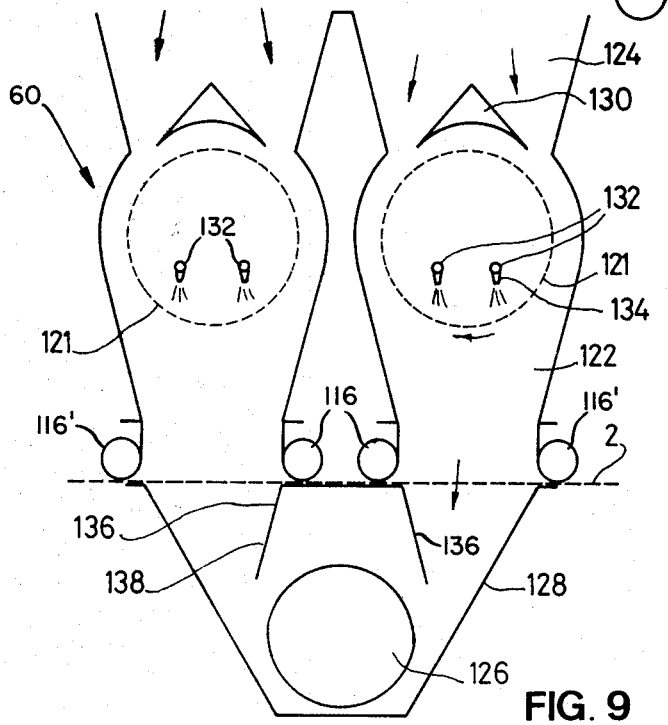
FIG. 9 is a view corresponding to FIG. 8, but showing another embodiment of the invention.

FIG. 9 shows, in a view corresponding to FIG. 8, a modified arrangement for the distributor unit 60, designated 60'. In this arrangement, the rotary screen tubes are designated 121, and are placed in respective chambers 122. The chambers 122 open directly, downwardly to the top surface of the moving forming web 2. The upper ends of chambers 122 constitute air intake openings 124 which, in a manner not shown, may be interconnected with the exhaust 126 from the lower suction box 128 by means of suitable fan means. Just above each tube 120 is arranged a stationary air diverter structure 130. Air diverter 130 serves to bleed the downward flow of air through the chamber 122 in a smooth manner along the sides of tube 121. The diverter 130 may be combined with valve means for adjusting the air flow.

Inside of each tube 121 is arranged a pair of compressed air supply pipes 132. The pipes 132 have downwardly-directed air nozzles 134, whereby, in operation, fibers from the flow through the tubes 121 will be thrown directly downwardly through the screen walls of the tubes 121 towards the forming sheet 2. An inverted U-member 136 is located inside the suction box 128. U-member 136 has wing portions 138 which may serve as individually-adjustable valve plates, thereby enabling the air flow through the fiber depositing areas of the respective tubes 121 to be adjusted. Generally, the air penetration resistance through the forming sheet 2 would be higher underneath the downstream one of the two tubes 121, relative to the direction of movement of the forming sheet. This behavior is because the fiber layer on the web is relatively thick at this location, so that an adjustment capability for the air flow and pressure at this location will be advantageous.

Material flow in the closed conduit system may, of course, be further supported by means of air nozzles providing local air jets through which fiber material may be supplied into the flow at some appropriate place, rather than being supplied together with a flow of transportation air, as used in the above examples.

Figure 10:
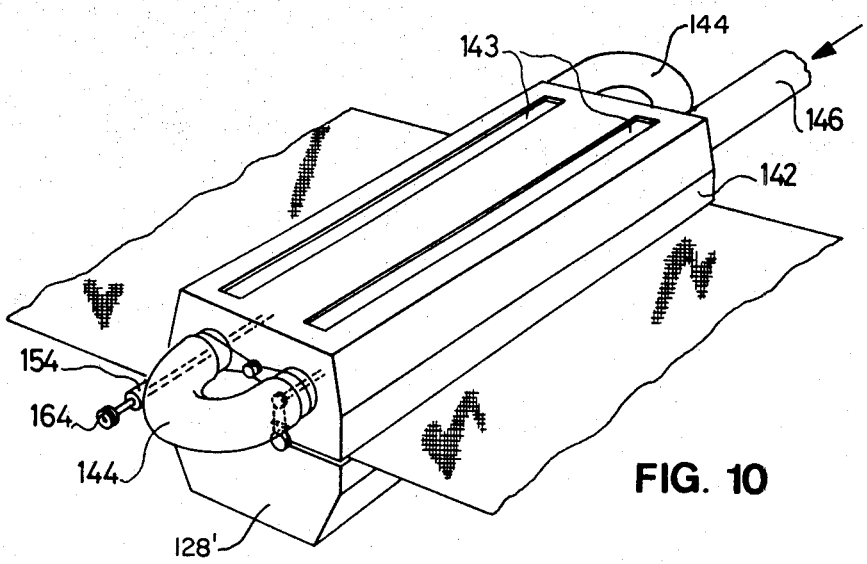
FIG. 10 is a perspective view of yet another modified embodiment of the present invention.
Figure 11:
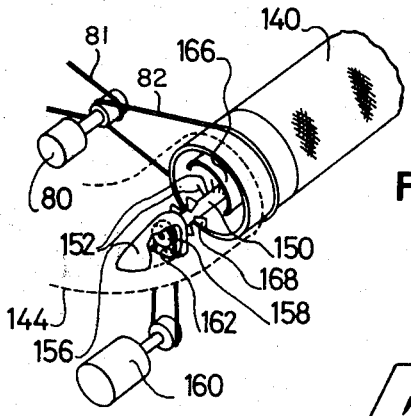
FIG. 11 is a partial perspective view of a screen tube and needle cylinder arrangement of the FIG. 10 embodiment.

The apparatus shown in FIG. 9 may be modified by the omission of the middle wall portions of the housing between the two screen tubes, i.e., the screen tubes may extend through a common housing. Another arrangement, whereby rotary screen tubes are placed in a common housing, can be seen with reference to FIGS. 10–12. In this embodiment, two rotary screen tubes 140 are located in a common housing 142. Housing 142 has upper air intake slots 143. Screen tubes 140 are endwise interconnected through half-circular connector pipes 144. One of these connector pipes 144 may be used for supplying fiber laden air via a supply pipe 146 tangentially intersecting therewith. While, in the foregoing embodiments, the fibers are forced crossways out of the screen tubes by means of compressed air, through suitable nozzles, an alternative approach is taken in the embodiment of FIGS. 10–12. That is, with reference to FIGS. 11 and 12, fibers can be removed from the circulating fiber-air flow and thrown out through the screen tubes 140 by a needle cylinder 148 located inside each screen tube and extending along the full length thereof. Each needle cylinder 148 is arranged in a slightly eccentric location and comprises a shaft 150 (which may be solid or tubular) and which carries a relatively high number of thin, radially-protruding needles 152. The needles 152 may be arranged in any arbitrary pattern on the shaft 150, though a screw line pattern, such as shown in FIG. 11, may be preferred. The shafts 150 are mounted in rotational bearings adjacent the ends of the screen tubes exteriorly of the connector tubes 144, as shown at 154 in FIG. 10, or, preferably, inside the connector tubes 144, as shown at the right-hand side of the foremost tube 144 in FIG. 10. In the latter arrangement, the bearing is mounted in a housing 156 that is of generally streamlined configuration and is fixed to the bottom portion of one of the connector tubes 144. Inside the housing 156, the shaft 150 is provided with a pulley 158 which is drive belt connected with a motor 160 through a slot 162 in the bottom wall of the tube 144. The needle cylinder 150 may be rotated at relatively high speed by this motor drive arrangement. Of course, the opposite shaft, through the bearing 154, may be correspondingly rotated by any suitable driven arrangement (not shown) cooperating with a pinion or pulley 164 on the outer end of the associated shaft 150.

In operation, the screen tubes 140 are rotated at moderate speed by the motor 80 and cooperating belts 81, 82, and the needle cylinders 148 are rotated at higher speed. A flow of air-suspended fibers and/or particles is introduced through the supply pipe 146 so as to create a circulating flow in the pipe system comprising the two parallel screen tubes 140 and the opposed half-cylindrical connector tubes 144. The needles 152 operate to exert a centrifugal action on the circulating flow in each cross-section along each screen tube 140, without preventing the general axial flow therethrough. As most clearly shown in FIG. 12, the exterior diameter of the needle cylinders 148 is preferably smaller than the interior screen tube diameter, whereby the resistance against the important general axial air-fiber flow is kept relatively low. However, the rotating needle cylinders 148 will generally add an outwardly-directed component of movement to the air-fiber flow and a positive throwing-out of air and fibers through the screen tube wall portions will result therefrom. Of course, the throwing-out effect will be most pronounced in the areas of close positional relationship between the needle cylinders and the inside of the screen tubes 140.

Figure 12:
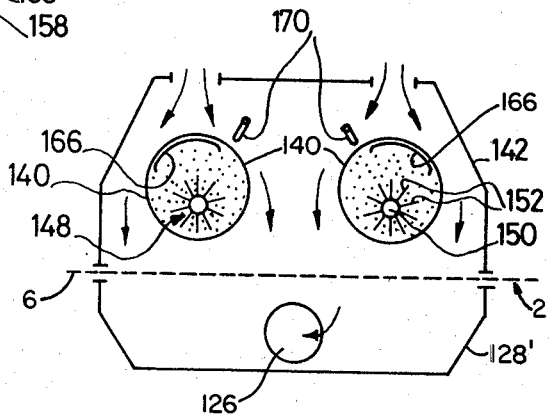
FIG. 12 is a cross-sectional view of the FIG. 10 embodiment.

As shown in FIG. 12, in order to counteract an upward throwing-out of fibers, stationary shield plate members 166 may be arranged inside the screen tubes just underneath the top portion thereof. These plate members are endwise supported, in a manner not shown, so as to remain stationary.

In order to promote the axial flow of the air suspended fibers through the screen tubes 140, the shafts 150, of the needle cylinders 148, may be provided with fan wings 168, as shown in FIG. 11. Such axial blower wings may be provided only on the end of the shafts 150, or at several places spaced therealong.

Also, in this embodiment, it is preferred to provide a means for continuously cleaning the rotating screen tubes. For this purpose, a longitudinal system of stationary air nozzles 170 (FIG. 12) are provided. These nozzles 170 operate to blow a jet of air against the rotating screen wall. In FIG. 12, these nozzles are shown located outside the screen tubes, but they might as well be located inside the tubes.

It will be appreciated that the rotating needle cylinders 148 will tend to create a screw-lined motion of the air-fiber flow through the screen tubes 140. This creates a relative flow sweep in the peripheral direction of the screen tubes. For this reason, it is not considered mandatory that the screen tubes are rotated at all, so that they may be constituted by fixed tubular elements. In such an instance, only the lower half need actually be made a screen wall portion. Should it be desired to effect a particular cleaning thereof, it will then be possible to arrange for the air nozzles 170 to be rotated about the axis of the screen tubes, whether these nozzles are arranged inside or outside the screen tubes.

It will, of course, be possible to arrange for more than one needle cylinder 148 inside a screen tube 140.

The needles 152 may have any suitable shape, but preferably are of round cross-section. If made with a flattened cross-sectional shape, they may well be arranged so as to produce a certain additional axial blower action. Otherwise, it does not matter whether the needle cylinders are rotated in one direction or the other, though, in practice, a specific direction of rotation may be preferred. The same applies to the screen tubes.

As can be seen from the foregoing, common to all of the disclosed embodiments are the characteristics that a circulation of air suspended fibers or particles, and removal of fibers from the flow for depositing on the moving forming web are achieved by separate means in a manner which will enable the maximum degree of flexibility and uniform fiber deposition to be achieved without interference from fiber clumps.

While we have shown and described various embodiments in accordance with the present invention, it is understood that the same is not limited thereto, but is susceptible of numerous changes and modifications as known to those skilled in the art and we, therefore, do not wish to be limited to the details shown and described herein, but intend to cover all such changes and modifications as are encompassed by the scope of the appended claims.

We claim:

1. Apparatus for dry forming at least one of particles and fibers into a web-like material comprising:

(a) a moving foraminous forming sheet;

(b) a distributor unit positioned above said forming sheet with an outlet thereof directed toward and extending across said forming sheet; and (c) suction means positioned beneath said forming sheet for sucking air downward through the forming sheet and for conveying said particles and fibers from said distributor unit outlet toward said forming sheet;

wherein said distributor unit comprises:

(1) an inlet for material comprising at least one of fibers and particles;

(2) a flow producing means for recirculating a flow of said particles and fibers in a path extending across said forming sheet within said distributor unit between said inlet and outlet, said flow producing means being formed at least in part by a flow guiding pipe, at least a portion of which is formed by a perforated outlet screen wall; and (3) means, within said flow guiding pipe, for directing a portion of said flow of particles and fibers outwardly through said outlet screen wall.

2. Apparatus according to claim 1, wherein said flow guiding pipe defines a closed material flow circuit.

3. Apparatus according to claim 1 or 2, wherein said pipe is rotatably mounted within said distributor unit, and substantially stationary screen cleaning means are provided for cleaning the perforated screen wall from outside the pipe.

4. Apparatus according to claim 3, wherein the pipe is made entirely of classification screen material and is arranged for continuous or intermittent one-way rotation.

5. Apparatus according to claim 2, wherein said means for directing a portion of said flow also performs at least one of agitating, disintegrating, and axially conveying said flow in the pipe.

6. Apparatus according to claim 2, wherein said means for directing comprises a rotating needle cylinder.

7. Apparatus according to claim 6, wherein the needle cylinder has needles arranged along a screw line on the cylinder.

8. Apparatus according to claim 2, wherein said means for directing comprises a system of air nozzles mounted on stationary carrier means and operable to blow an air jet against the inside of the outlet screen wall of the pipe.

9. Apparatus according to claim 6 or 8, wherein said means for performing is arranged eccentrically within said pipe.

10. Apparatus according to claim 4, wherein a shield plate means is mounted stationarily inside the pipe adjacent a top portion thereof.

11. In an apparatus for producing a non-woven web of the type comprising:

(a) a moving foraminous forming sheet;

(b) a distributor container positioned above said forming sheet, said container having inlet means for receiving a supply of material comprising at least one of fibers and particles and outlet means for gradual delivery of said material in a broad flow towards said moving forming sheet;

(c) means for maintaining said material air fluidized in said distributor container and moving generally in a flow in a closed material conducting circuit across said forming sheet; and (d) power exerting means located in said distributor container for subjecting portions of the material in the closed circuit flow to positive cross displacement forces to impart a component of movement directed crosswise towards said outlet means;

the improvement wherein:

(1) said means for maintaining comprising flow conducting means and means for transporting said supply of material by way of transportation air, said closed material conducting circuit being formed by said flow conducting means in conjunction with said distributor container; and (2) said power exerting means is at least partly comprised by nozzle means for providing jets of air directed generally toward said outlet means.

12. Apparatus according to claim 11, wherein the nozzle means are arranged so as to effect an upwardly directed throwing or displacement action on portions of the material towards outlet means located overhead, the outlet means communicating with a relatively wide material downlet chamber, said chamber having an open bottom located just above the moving forming sheet.

13. Apparatus according to claim 11, wherein the said outlet means include a classification screen.

14. Apparatus according to claim 11, wherein a container portion conducting material flow across the moving forming sheet is tubular, having outlet apertures located over at least a partial outlet wall portion, said container portion being at least periodically rotatable about its longitudinal axis, while inside the container said nozzles are stationarily arranged to blow air against a longitudinal wall area which is narrower than the width of said outlet wall portion.

15. Apparatus according to claim 14, wherein the tubular container portion is generally made of a classification screen material having outlet apertures located all over the area thereof.

16. Apparatus according to claim 15, wherein the tubular container portion is arranged for continuous unidirectional rotation.

17. Apparatus according to claim 14 or 15 or 16, wherein the tubular container portion is arranged directly overhead the moving forming sheet and the nozzle means inside the container are arranged so as to effect blowing generally downwardly.

18. Apparatus according to claim 12, wherein the overhead outlet means communicates with an upper receiving chamber, said receiving chamber narrowing upwardly towards a slot-shaped passage, said slot-shaped passage cooperating with air nozzle means and connecting the receiving chamber with an uppermost conductor chamber having upwardly diverging walls and continuing via an upper bend into a downlet chamber through which the material is guided to be deposited onto the moving forming sheet.

19. Apparatus according to claim 14, in which the tubular container portion is arranged inside a chamber which communicates with air intake means located upstream of an effective outlet direction of the material from the outlet means of the distributor container.

20. Apparatus according to claim 2 or 11, in which the closed material flow circuit is conducted by one tubular distributor container portion in one direction across the moving forming sheet and by a similar container portion in an opposite direction.

21. Apparatus according to claim 20, wherein outlet means of the two tubular container portions communicate with a common downlet chamber leading to the upper surface of the moving forming sheet.

22. Apparatus according to claim 2 or 11, wherein the closed material flow circuit comprises, at least at one side of the moving forming sheet, an arched tube portion in which sensor means are arranged for detecting the thickness of the material flow as forced against the outer wall of the arched tube, said sensor means being operatively connected with means for controlling the supply of new material to the distributor system.

23. Apparatus according to claim 11, in which the power exerting means for effecting positive cross displacement of the material inside the container are operable to exert displacement forces which vary along the length of the container.

24. Apparatus according to claim 11, wherein a container portion conducting the material flow across the moving forming sheet is tubular, having outlet apertures located over at least a partial outlet wall portion, said container portion being stationary, while inside the container said nozzles are arranged for relative rotational movement.

25. Apparatus according to claim 24, wherein the tubular container portion is generally made of a classification screen material having outlet apertures located all over the area thereof.

26. In an apparatus for producing a non-woven web of the type comprising:

(a) a moving foraminous forming sheet;

(b) a distributor container positioned above said forming sheet, said container having inlet means for receiving a supply of material comprising at least one of fibers and particles and outlet means for gradual delivery of said material in a broad flow towards said moving forming sheet;

(c) means for maintaining said material air fluidized in said distributor container and moving generally in a flow in a closed material conducting circuit across said forming sheet; and (d) power exerting means located in said distributor container for subjecting portions of the material in the closed circuit flow to positive cross displacement forces to impart a component of movement directed crosswise towards said outlet means;

the improvement wherein:

(1) said means for maintaining comprising flow conducting means and means for transporting said supply of material by way of transportation air, said closed material conducting circuit being formed by said flow conducting means in conjunction with said distributor container; and (2) said power exerting means is at least partly comprised by a rotary needle cylinder located inside a portion of said flow conducting means situated within said distributor container in a manner so as to generally subjecting the material in the closed circuit flow to a centrifugal action without substantially obstructing the closed circuit flow.

27. Apparatus according to claim 26, in which the needle cylinder is mounted inside a tubular, rotatable container portion in an eccentric position therein.

28. Apparatus according to claim 27, wherein said container portion is formed of classification screen material.

29. Apparatus according to claim 26, wherein said needle cylinder is mounted inside a tubular container portion, at least part of which has exposed classification openings through which portions of said material are directed by said needle cylinder.

30. Apparatus according to claim 29, wherein said tubular container portion is comprised of classification screen material and stationary shield plate members are arranged under a top area of the tubular container portion.

31. Apparatus according to claim 30, wherein air nozzles are provided exteriorly of said tubular container portion for directing cleaning air jets thereagainst.

32. Apparatus according to claim 27 or 29, wherein said needle cylinder comprises a shaft having radially-extending needles projecting therefrom in a screw line pattern.

33. Apparatus according to claim 11 or 27, wherein said flow conducting means comprises conduit sections connected to said distributor container and a material disintegrator, and wherein said means for transporting comprises an air blower associated with said conduit sections for producing a flow of said transportation air through said conduit sections, to and from said distributor container and material disintegrator.

* * * * *